US007918317B2

(12) United States Patent
Adolf et al.

(10) Patent No.: US 7,918,317 B2
(45) Date of Patent: Apr. 5, 2011

(54) LUBRICATING OIL DOSING ARRANGEMENT

(75) Inventors: Ingobert Adolf, Friedrichshafen (DE); Michael Greil, Markdorf (DE); Ludwig Kläser-Jenewein, Frickingen (DE)

(73) Assignee: MTU Friedrichs Hafen GmbH, Friedrichshafen (DE)

( * ) Notice: Subject to any disclaimer, the term of this patent is extended or adjusted under 35 U.S.C. 154(b) by 1108 days.

(21) Appl. No.: 11/656,751

(22) Filed: Jan. 23, 2007

(65) Prior Publication Data

US 2007/0175705 A1 Aug. 2, 2007

(30) Foreign Application Priority Data

Feb. 1, 2006 (DE) ..... 10 2006 004 515

(51) Int. Cl.
*F01M 1/04* (2006.01)

(52) U.S. Cl. ..... 184/6.5; 184/6.6; 184/6.9; 123/196 CP; 417/437

(58) Field of Classification Search ..... 184/6.5, 184/6.6, 6.8, 6.12; 137/454.2, 196 CP; 417/437, 417/383

See application file for complete search history.

(56) References Cited

U.S. PATENT DOCUMENTS

| | | | | |
|---|---|---|---|---|
| 3,788,295 | A * | 1/1974 | Toth | 123/188.6 |
| 4,441,317 | A * | 4/1984 | Wolfe et al. | 60/527 |
| 2006/0081804 | A1* | 4/2006 | Cong | 251/144 |
| 2006/0231141 | A1* | 10/2006 | Shay | 137/454.2 |

FOREIGN PATENT DOCUMENTS

DE 10 2004 027 107 12/2003

* cited by examiner

*Primary Examiner* — Michael R Mansen
*Assistant Examiner* — Robert T Reese
(74) *Attorney, Agent, or Firm* — Klaus J. Bach

(57) ABSTRACT

In a lubricant dosing arrangement for the lubrication of valve shafts on the cylinder heads of piston engine wherein the valve shafts are axially movably supported in housing bores formed in the cylinder heads and the housing bores include spaced lubricant seals so as to form between the seals around the valve shaft lubricant reservoirs, means are provided for supplying lubricant to the lubricant reservoirs and the valves shafts include means for permitting passage of lubricant out of the reservoir at a rate depending on the lift movement of the valve shafts so as to dose the lubricant volume permitted to flow out of the lubricant reservoir for the lubrication of the valve shaft.

7 Claims, 3 Drawing Sheets

LUBRICATING OIL DOSING ARRANGEMENT

BACKGROUND OF THE INVENTION

The invention relates to a lubricating oil dosing arrangement for the valves of an internal combustion engine, wherein the valves have valve shafts and are movably in guide bores formed in the cylinder head of the internal combustion engine.

Conventional reciprocating piston engines include cylinders with cylinder heads in which inlet and outlet valves are movably supported in cylindrical guide bores, so that they are subject to wear which is minimized by the addition of lubricant. For minimizing the wear of the valve shafts, engine oil is supplied by a dosing pump from the oil circuit of the engine to the inlet valve shafts or, via passages, directly to the valve guides, particularly the outlet valve guides. For reducing noxious emissions caused by the combustion of excessive amounts of lubricating oil and for reducing blow-by air, air fuel mixture or exhaust gas to flow out of the cylinder of the internal combustion engine through the gap between the bore and the valve caps, O-rings are installed as seals on, or in, the valve shaft guide bores in today's piston engines.

G 90 00 671.2 discloses a lubrication arrangement for valves of a piston engine wherein, for the control of the lubricant passing between the valve shaft and the bore, a seal ring with a seal lip is provided.

JP 59 049307 discloses a lubrication arrangement for valves which includes seal rings arranged between the valve shaft and the cylindrical guide bore. The seal ring is arranged axially movably in a groove of the cylindrical bore and is moved back and forth in the groove by the valve shaft by friction with each valve lift for the transport of lubricant. Lubricant is pumped from a larger upper gap to a lower smaller gap along the valve shaft and the cylindrical guide bore.

DE 29 35 260 A1 discloses a seal for mounting onto the end of a cylindrical guide projection of a valve shaft guide bore structure. This seal includes a rigid seal body with an annular guard plate, which surrounds the guide projection, an upper essentially cylindrical wall, which is connected to the annular guide plate, a radially inwardly extending web at the inner surface of the wall and an elastic insert having an outer annular groove accommodating the rib, wherein between the rib and the outer annular groove an oil reservoir is provided. Upon back and forth movement of the valve shaft, the elastic insert is moved along with the valve by friction and opens and closes the oil reservoir between the rib and the outer annular groove upwardly for supplying oil from the valve drive and downwardly for admitting oil to the gap between the valve shaft and the cylindrical bore in direction toward the valve seat.

DE 28 28 981 A1 discloses a valve shaft seal at the end of a cylindrical valve guide projection wherein an annular sleeve section surrounds a valve guide section. A transversely extending wall is disposed at the upper end of the valve guide projection and sealingly abuts the valve shaft. The transversely extending wall includes an inner surface provided with two-axially spaced annular seal sections which are separated from an annular groove disposed adjacent the upper end of the valve guide projection. The underside of the transverse extending wall intersects the lower seal section in such a way that a sharp edge is formed. An inner surface which is inclined upwardly and outwardly extends to the upper side of the transversely extending wall and causes a capillary oil flow to the seal sections.

The valve shaft seals of the state of the art detrimentally affect to a different degree the lubricant supply to the valve guide structures and, at least for the inlet valves, also the lubricant supply to the valve disk which may result in an increased wear of the valve shaft, the valve guide, the valve disk and/or the valve seat ring. Particularly the dosing of the lubricant amount for each valve guide is unsatisfactory and/or the costs of such lubricant supply arrangements are excessive.

It is the object of the present invention to provide a technically simple and therefore inexpensive lubricant dosing arrangement for valves by which to each valve in the cylinder heads of piston engines a predetermined amount of lubricant can be supplied.

SUMMARY OF THE INVENTION

In a lubricant dosing arrangement for the lubrication of valve shafts in the cylinder heads of piston engines wherein the valve shafts are axially movably supported in housing bores formed in the cylinder heads and the housing bores include spaced lubricant seals so as to form between the seals around the valve shaft lubricant reservoirs, means are provided for supplying lubricant to the lubricant reservoirs and the valve shafts include means for permitting passage of lubricant out of the reservoir at a rate depending on the lift movement of the valve shafts so as to dose the lubricant volume permitted to flow out of the lubricant reservoirs for the lubrication of the valve shafts.

The first seal adjacent the upper end of the valve shaft forms an absolute barrier for the lubricant between the first and the second seals, the bore and the valve shaft. The second seal facing the valve seat can be bypassed by the lubricant depending on the lift movement of the valve shaft and provides for a predetermined exactly defined lubricant volume, without a dosing pump, which, for example, can serve for the lubrication of a lubrication gap between a valve shaft and a guide bore as well as for the lubrication of a valve seat.

In accordance with a preferred embodiment of the invention, the guide bore is provided in a housing in the cylinder head for simplified manufacturing of the lubricant dosing arrangement.

In a first alternative embodiment, wherein the spaced first and second seals are held in the guide bore and on the valve shaft, at least one groove serving as a lubricant reservoir is provided, which extends axially in the valve shaft to an extent which is less than the distance between the first and the second seals. With the valve closed, the groove is disposed completely between the first and the second seals and lubricant supplied from the lubricant supply line cannot flow out of the lubricant reservoir into the gap between the valve shaft and the bore toward the valve seals. When the valve is open, the groove in the valve shaft extends beyond the second seal so that lubricant admitted from the lubricant supply line can flow via the groove out of the lubricant reservoir in a dosed manner past the second seal the gap between the guide bore and the valve shaft for lubricating toward the valve seat for lubricating the valve shaft.

In accordance with a second alternative embodiment, the lubricant reservoir is provided in the form of a through-bore extending through the valve shaft at an inclined angle with respect to the valve shaft axis. When the valve is closed, the through-bore is disposed fully between the first and the second seals. With the valve in its open position, the trough-bore opening facing the valve seat is disposed past the second seal in the direction toward the valve seat so that lubricant supplied by a lubricant supply line to the space between the two seals is discharged from the lubricant reservoir in a dosed manner into the gap between the guide bore and the valve shaft toward the valve seat for lubrication.

In a preferred arrangement of the invention, the lubricant in the lubricant supply line is pressurized so that any air, air fuel mixture or exhaust gas from is prevented from flowing from the cylinder of the piston engine through the gap between the guide bore and the valve shaft.

In a third alternative embodiment of the invention, the first seal is supported in the guide bore and the second seal, preferably in the form of a seal ring, is supported on the valve shaft so that during operation of the engine, the lubricant reservoir volume formed between the first and the second seal, the guide bore and the valve shaft is changed by the movement of the second seal together with the valve shaft. The first seal of this arrangement does not permit any passage of lubricant supplied via the lubricant supply line. When the valve opens, the second valve increases, by its downward movement, the volume of the lubricant reservoir so that lubricant flows out of lubricant supply line into the reservoir. During the closing movement of the valve the second seal, by its upward movement, reduces the volume of the lubricant reservoir and also permits passage of a defined amount of lubricant into a lubricant dosing volume which is also varied by the second seal with the movement of the valve and which is formed by the guide bore in the housing, the second seal, a radial shoulder between the guide bore in the housing with a diameter $d_2$ and the guide bore in the cylinder head with the diameter $d_1$. The lubricant dosing volume is increased during the closing movement of the valve. The second seal does not permit passage of lubricant during the opening movement of the valve so that, with each closing of the valve the second seal assumes a dosing function and with each opening of the valve, the second seal assumes a pumping function for the dosed lubricant out of the lubricant dosing volume for lubricating the gap between the guide bore and the valve shaft in the direction toward the valve seat.

In a preferred configuration of the third embodiment of the invention, the lubricant supply line includes an automatic blocking device, preferably a check valve, so that no air, air fuel mixture or exhaust gas can flow out of the cylinder of the engine through the gap between the guide bore and the valve shaft.

In another advantageous configuration of the third alternative embodiment of the invention, the second seal, which is in the form of a seal ring, is provided with a seal lip that extends up to the bore wall and permits passage of pressurized lubricant between the bore wall and the valve shaft toward the valve seat but sealingly engages the bore wall when subjected to pressure fluid in the opposite direction and does not permit any lubricant, air, air/fuel mixture or exhaust gas to flow out of the cylinder of the piston engine along the valve shaft. The second seal is preferably supported in a groove in the valve shaft.

In a preferred configuration of a fourth alternative embodiment of the invention, the inner diameter of the housing guide bore is enlarged at the upper end of the bore so as to form a storage space for lubricant. The first seal disposed in the guide bore adjacent the upper end of the valve shaft and the second seal arranged on the valve shaft closer to the valve seat are both in the form of seal rings. During operation of the engine—like in the second alternative embodiment of the invention—the volume of the lubricant reservoir formed by the first and second seal, the bore and the valve shaft is varied with the movement of the valve shaft. From a lubricant storage space disposed at a higher elevation or from the enlarged diameter space at the upper end of the guide bore a lubricant supply passage extends to the area between the first seal in the bore and the second seal on the valve shaft. When the valve opens lubricant is admitted to the space between the two seals which is increased by the downward movement of the valve. When the valve is subsequently closed and the second seal moves upwardly together with the valve the lubricant volume between the two seals becomes smaller. The first seal does not permit return flow of lubricant while the second seal permits passage of lubricant out of the lubricant volume between the seal and the guide bore wall into a lubricant dosing volume which is delimited by the guide bore in the housing, the second seal, a radial shoulder between the bore with the diameter $d_2$ and the guide bore with the diameter $d_1$ and the valve shaft 1. During the opening movement of the valve, the second seal does not permit passage of lubricant so that, with each closing of the valve, the second seal assumes a dosing function and, with each opening of the valve, the second seal assumes a pumping function for moving a dosed amount of lubricant into the gap between the guide bore and the valve shaft toward the valve seat.

Preferably, the first seal ring supported in the housing bore is provided with a seal lip which engages the valve shaft and the second seal ring supported by the valve shaft is provided with a seal lip engaging the bore wall of the housing so that air, air/fuel mixtures or exhaust gas is prevented from flowing out of the cylinder of the piston engine into the gap between the bore and the valve shaft.

Preferred embodiments of the invention will be described below on the basis of the accompanying drawings.

DESCRIPTION OF PARTICULAR EMBODIMENTS

Figure 1:
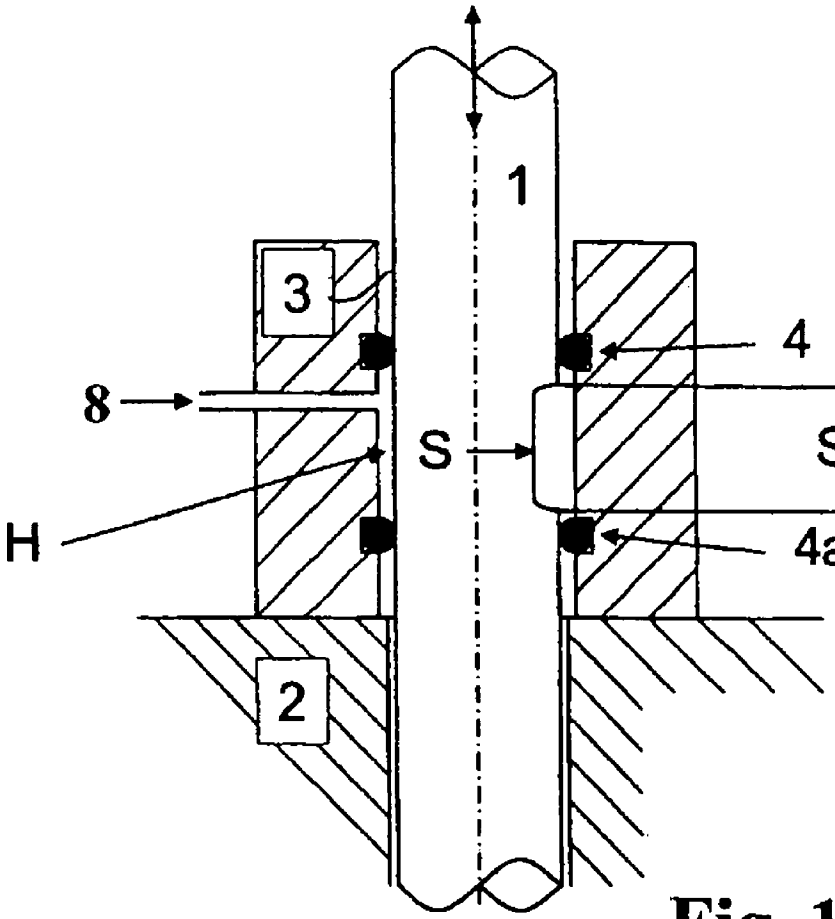

FIG. 1 shows a lubricant dosing arrangement including a valve shaft 1 of a closed valve in a guide bore 2 of a cylinder head of a piston engine (not shown). A housing provided with a housing bore 3 in alignment with the guide bore 2 includes a first seal 4 near the upper end of the valve shaft 1 and a second seal 4*a* spaced from the first seal 4 toward the valve seat and arranged co-axially with the valve shaft 1 in the housing bore 3. A lubricant supply line 8 extends to the housing bore 3 in an area of a lubricant reservoir H formed around the valve shaft 1 between the first and the second seals (4, 4*a*). One or more grooves S with an axial length Sh are provided in the valve shaft 1 so that, in the closed position of the valve, the grooves are disposed completely between the seals 4, 4*a*.

Figure 2:
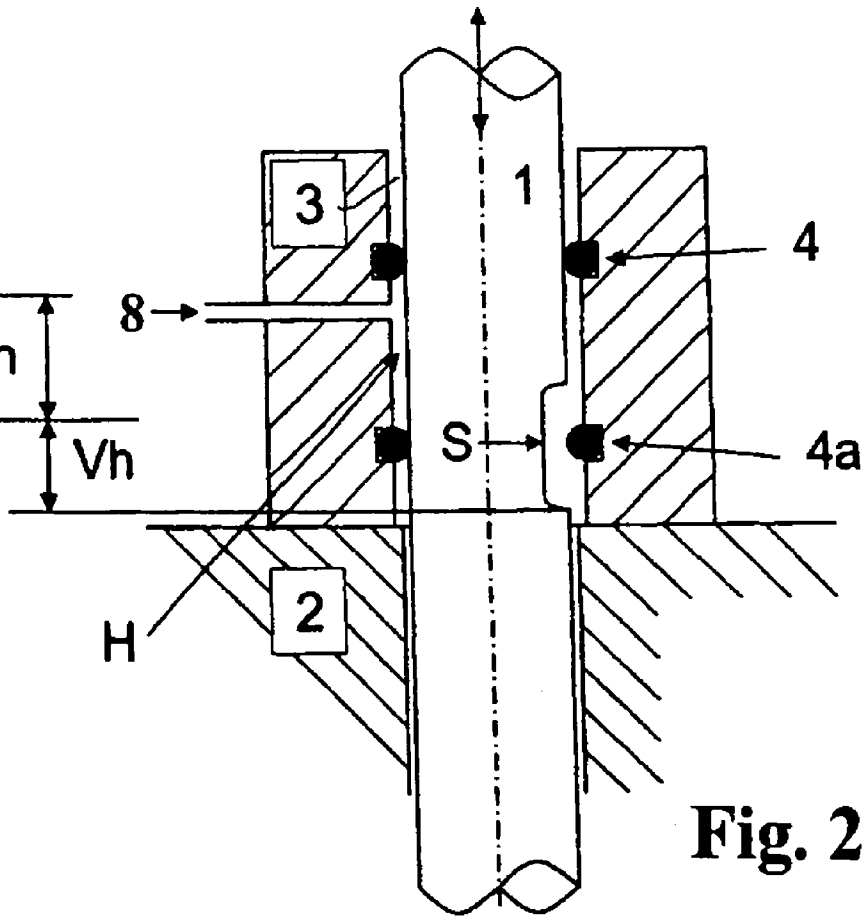
FIGS. 1 and 2 are cross-sectional views of a lubricant dosing arrangement showing the arrangement with a shaft in different positions.
Figures 3, 4:
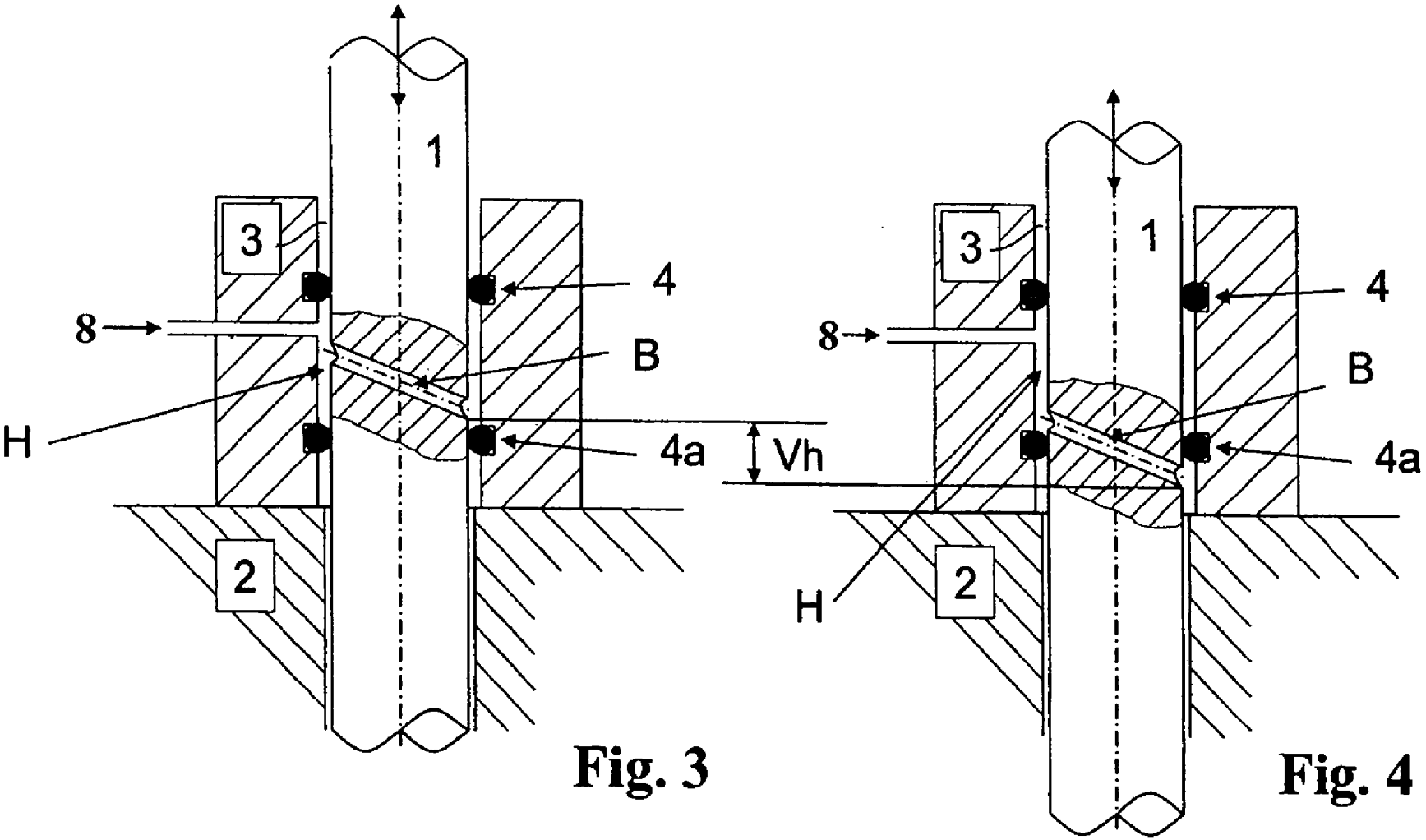
FIGS. 3 and 4 show an alternative arrangement wherein the shaft is also shown in two different positions.

In FIG. 2, features corresponding to those shown in FIG. 1 are designated by the same reference numerals. FIG. 2 shows the valve shaft in an open position of the valve wherein the valve shaft 1 is moved downwardly by the valve lift Vh in the valve guide bore 2 of the cylinder head. In this position, the groove S in the valve shaft 1 extends downwardly beyond the second seal 4*a* so that lubricant can flow from the lubricant reservoir H past the seal 4*a* into the valve guide bore 2. In FIGS. 3 and 4, features corresponding to those shown in FIGS. 1 and 2 are designated by the same reference numerals.

Instead of an axial groove S formed in the valve shaft 1 in this embodiment, a through-bore B is provided in the valve shaft 1 which bore B is inclined with respect to the valve shaft axis. The first and second seals 4, 4*a*, the housing bore 3, the through bore B and the valve shaft 1 form a lubricant reservoir H. The inclination angle of the through bore is such that the inlet and outlet openings of the through-bore B are both disposed between the first and the second seals 4 and 4*a*, but that, in the open position of the valve, the outlet opening of the through-bore B is disposed past the second seal 4*a* in the direction toward the valve seat so that the lubricant can flow out of the lubricant reservoir H into the valve guide bore 2.

Figures 5, 6:
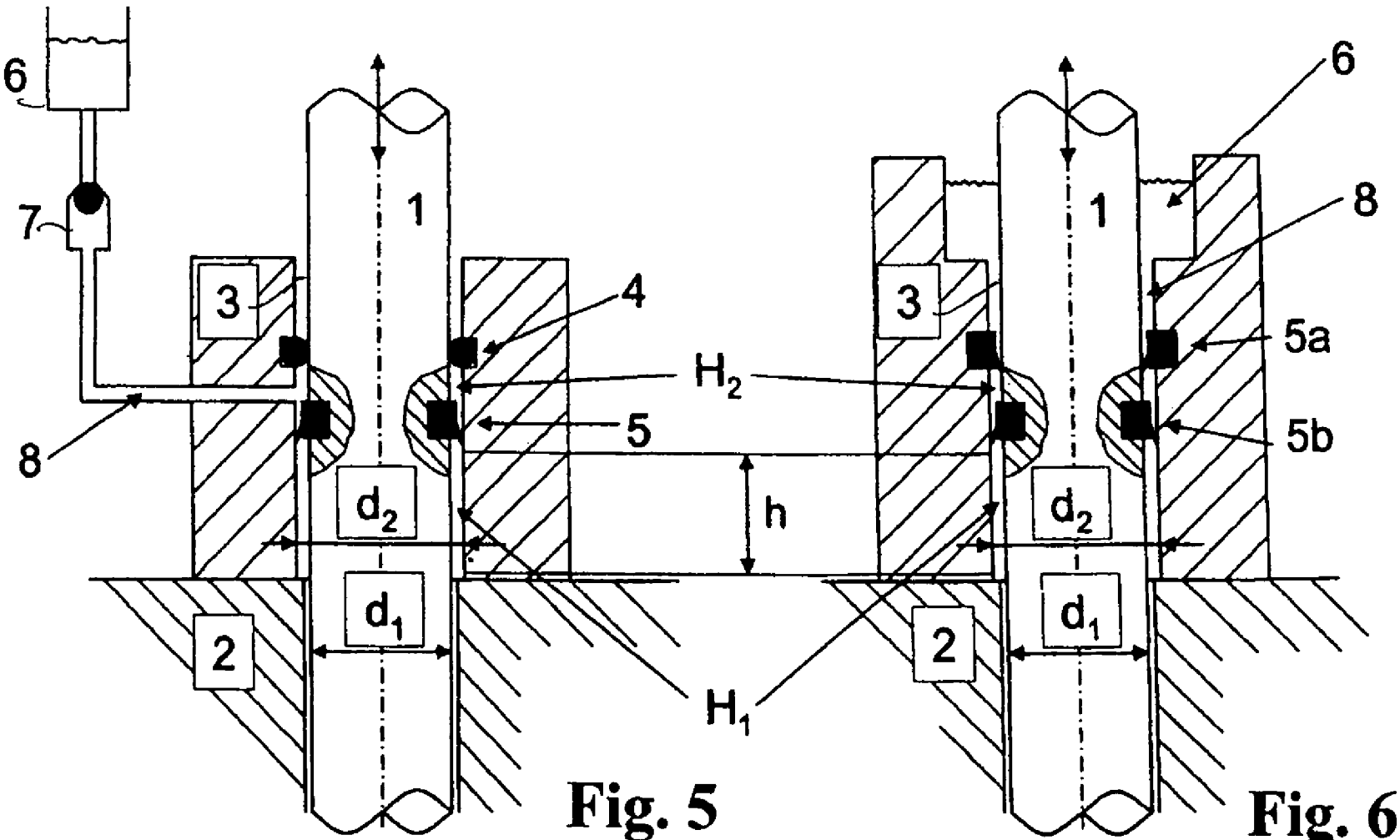
FIG. 5 is a cross-sectional view of a lubricant dosing arrangement including a pumping function.
FIG. 6 shows another lubricant dosing arrangement with a pumping function.

FIG. 5 shows a lubricant dosing arrangement wherein the valve shaft 1 with a diameter $d_1$ is guided in a valve guide bore 2 of a cylinder head of a piston engine (not shown). The housing bore 3 with a diameter $d_2$ which is somewhat larger than the diameter $d_1$ of the valve guide bore 2 includes in the cylinder head a first seal 4 near the upper end of the valve shaft 1. The first seal 4 is for example an O-ring. A second seal ring 5 is mounted on the valve shaft 1 in spaced relationship from the first seal ring 4 in a direction toward the valve seat and is provided with an elastic seal lip abutting the wall of the housing bore 3. The first seal ring 4 and the second seal ring 5 are both accommodated in circumferential grooves in the housing bore wall 3 or, respectively, in the valve shaft 9.

Lubricant from a reservoir 6 can be supplied, via a check valve 7 disposed in a supply line 8, to the housing bore 3 between the first and the second seal rings 4 and 5. The housing bore 3, the seal ring 5 a radial shoulder between the guide bore 2 with the diameter $d_1$ and the housing bore 3 with the diameter $d_2$ and the valve shaft 1 delimit a lubricant dosing volume $H_1$ and the first seal ring 4, the housing bore 3 and the valve shaft 1 delimit a lubricant reservoir $H_2$, which changes its volume with the movement of the valve shaft 1 in a sense opposite to that of the dosing volume $H_1$.

FIG. 6 shows a similar lubricant dosing arrangement wherein the diameter of the housing opening 3 is increased at the upper end thereof so as to form a storage space 6 for the lubricant. The housing bore 3, which has a slightly larger diameter $d_2$ is provided with a first seal ring 5*a* disposed toward the upper end of the valve shaft 1 and including an elastic seal lip abutting the valve shaft 1. The second seal ring 5*b* disposed closer toward the valve seat is mounted onto the valve shaft 1 and has a seal lip abutting the wall of the housing bore 3. Each seal ring is mounted in an annular groove formed in the wall of the housing bore 3 or, respectively, in the valve shaft 1.

The storage space 6 is in controlled communication via the path 8, that is the gap between the valve shaft 1 and the wall of the housing bore 3, with the space between the first seal ring 5*a* and the second seal ring 5*b* via the seal ring 5*a*. The housing bore 3, the seal ring 5*b*, a radial shoulder between the valve guide bore 2 with the diameter $d_1$ and the wall of the housing bore 3 with the diameter $d_2$ delimit a lubricant dosing volume $H_1$ and the seal rings 5*a*, 5*b*, the wall of the housing bore 3 with a diameter $d_2$ and the valve shaft 1 delimit a lubricant reservoir $H_2$ whose volumes change with the movement of the valve shaft 1 in an opposite sense.

Operation of the Lubricant Dosing Arrangement

In the operating positions as shown in FIGS. 1 and 3, wherein the valves of two different embodiments of a lubricant dosing arrangement are shown pressurized lubricant is directed via the lubricant supply line 8 to the space H with the groove S or the through-bore B, which are filled with lubricant. The first and the second seals 4, 4*a* prevent the outflow of lubricant from the space H.

FIGS. 2 and 4 show the respective valve stems in an open position of the valve. In the open position of the valves, the valve shaft 1 with the groove S or with the through-bore B has moved downwardly so far that the groove S or the opening of the through-bore closer to the valve seat has moved past the seal 4*a* so that lubricant can flow into the gap between the guide bore 2 and the valve shaft 1. The lubricant amount flowing into the gap is adjustable by the time over which the groove S, which is filled with lubricant, extends beyond the seal 4*a*, by the length of the groove Sh, by the cross-section of the groove and by the number of grooves or, respectively, by the time in which the outlet opening of the through-bore 13 which is filled with lubricant is disposed beyond the seal 4*a*, the diameter and the number of through-bores B.

In the alternative arrangement as shown in FIG. 5, the lubricant of the dosing arrangement is supplied via the lubricant supply line 8 to the lubricant reservoir $H_2$. When the valve closes, that is, the valve shaft 1 moves upwardly, the lubricant reservoir $H_2$ becomes smaller and a defined lubricant amount flows past the flexible seal lip of the second seal 5, which amount depends on the valve stroke and the size of the gap between the valve shaft 1 and the wall of the housing bore 3. The second seal 5 acts as a check valve permitting lubricant flow toward the valve seat but blocking lubricant flow in the opposite direction so that during each closing at the valve a dosed amount of lubricant is moved past the seal 5 toward the valve seat into the dosing volume $H_1$, which then, upon opening of the valve, is pumped into the gap between the valve shaft 1 and the valve shaft guide bore 2.

In the alternative embodiment shown in FIG. 6, the housing bore 3 is widened at its upper end so as to form a storage chamber 6 for lubricant which is able to flow via the gap between the valve shaft 1 and the wall of the housing bore 3, which gap serves as a supply passage 8, into the space between the first seal 5*a* and the second seal 5*b*. Upon opening of the valve, the first seal 5*a* permits lubricant admitted from the storage chamber 6 to pass as the second seal 5*b*, which moves downwardly with the valve stem 1 causes the volume of the lubricant reservoir $H_2$ to increase. When the valve subsequently closes and the second seal 5*b* moves upwardly and the lubricant reservoir $H_2$ volume becomes smaller, the first seal 5*a* blocks the backflow of lubricant out of the lubricant reservoir to the storage chamber 6 but the second seal 5*b* permits passage of lubricant to the dosing volume $H_1$. During the opening movement of the valve, the second seal 5*b* pumps the lubricant volume accommodated by the dosing space $H_1$ during closing of the valve, out of the dosing space $H_1$ into the gap around the valve shaft for lubricating valve guide bore 2. The lubricant dose depends on valve stroke and the gap width between the valve shaft 1 and the wall of the housing bore 3.

What is claimed is:

1. A lubricant dosing arrangement for the lubrication of valve shafts in the cylinder heads of piston engines, each valve including a valve shaft (1) longitudinally movably supported in bores (2, 3) of the cylinder heads, and sealing means (4, 5*a*) disposed in the bores (2, 3) around said valve shaft (1) said sealing means (4, 5*a*) including axially spaced annular first and second seals (4, 5*a*; 5, 5*b*) so as to form a lubricant reservoir ($H_1$, $H_2$) the first seal (4, 5*a*) being supported by the wall of the housing bore (3) and the second seal (5, 5*b*) being supported by the valve shaft (1) so as to provide for a change of volume of the lubricant reservoir ($H_1$, $H_2$) with an axial movement of the valve shaft (1), the second seal (5, 5*b*) being designed to permit passage of lubricant in one direction of movement of the valve shaft for moving lubricant through the lubricant reservoir ($H_1$, $H_2$) in a dosed manner depending on the lift movement of the valve shaft (1).

2. A lubricant dosing arrangement according to claim 1, wherein a housing with a housing bore (3) is provided and disposed in alignment with a valve guide bore (2) and the valve shaft (1) extends through a housing bore (3) in the cylinder head and through the valve guide bore (2).

3. A lubricant dosing arrangement according to claim 2, wherein a lubricant supply line (8) extends to the lubricant reservoir (S) and lubricant supplied via the supply line (8) is subjected to pressure so that the lubricant supplied to the lubricant reservoir (S) is under pressure.

4. A lubricant dosing arrangement according to claim 1, wherein the second seal (5) is provided with a seal lip abutting the wall of the housing bore (3).

5. A lubricant dosing arrangement according to claim 1, wherein the second seal (5) is supported in a groove formed in the valve shaft (1).

6. A lubricant dosing arrangement according to claim 1, wherein the diameter of the housing bore (3) is radially widened at its upper end around the valve shaft (1) so as to form a lubricant storage chamber (6), said first and second seals (5*a*, 5*b*) being upper and lower seal rings, and wherein a lubricant supply passage (8) extends from the lubricant storage chamber (6) to the lubricant reservoir formed around the valve shaft between the first and second seals (5*a*, 5*b*).

7. A lubricant dosing arrangement according to claim 6, wherein the first seal ring (5*a*) includes a seal lip in contact with the valve shaft for permitting lubricant to flow from the storage chamber (6) along the valve shaft into the reservoir ($H_2$) but preventing backflow out of the reservoir ($H_2$).

* * * * *